United States Patent [19]

Treadwell

[11] 4,348,824

[45] Sep. 14, 1982

[54] SNOWSHOE AND HARNESS ASSEMBLY

[76] Inventor: Buford W. Treadwell, 10301 E. Division St., Cadillac, Mich. 49601

[21] Appl. No.: 226,437

[22] Filed: Jan. 19, 1981

[51] Int. Cl.[3] ..... A43B 5/04

[52] U.S. Cl. ..... 36/125

[58] Field of Search ..... 36/122, 123, 124, 125, 36/50

[56] References Cited

U.S. PATENT DOCUMENTS

| | | | |
|---|---|---|---|
| 1,747,213 | 2/1930 | Bates | 36/125 |
| 2,420,261 | 5/1947 | Nadeau | 36/125 |
| 2,619,742 | 12/1952 | Cumming | 36/125 |
| 2,821,031 | 1/1958 | Howe | 36/125 |
| 2,987,834 | 6/1961 | Howe | 36/125 |
| 3,000,117 | 9/1961 | Howe | 36/125 |
| 3,596,374 | 8/1971 | Covington | 36/125 |
| 3,638,333 | 2/1972 | Sprandel | 36/125 |
| 3,744,162 | 7/1973 | Beck | 36/125 |
| 3,755,926 | 9/1973 | Schonbrun | 36/125 |
| 3,965,584 | 6/1976 | Beaulieu | 36/125 |
| 3,992,790 | 11/1976 | Frye | 36/125 |
| 4,085,529 | 4/1978 | Merrifield | 36/125 |

*Primary Examiner*—Patrick D. Lawson

*Attorney, Agent, or Firm*—Lon H. Romanski

[57] ABSTRACT

A harness for a snowshoe having toe chord is shown as having an elongated binding extending generally tranversely of said snowshoe and being secured generally medially of opposite first and second ends to said toe chord as to have said first and second ends movable with respect to said snowshoe, first and second toe straps respectively secured to said first and second ends of said binding, a first strap fastener carried by said first strap, third and fourth heel strap respectively secured to the first and second ends of said binding, a second strap fastener carried by said third heel strap, the first and second toe strap being operative for drawing the first and second ends of the binding against opposite sides of a boot worn by a person walking on the snowshoe and the first fastener being effective to maintain the first and second ends tightly against the boot regardless of the size or configuration of the boot, the third and fourth heel straps being operative for drawing and holding the toe portion of the boot within the tightly engaging first and second ends and the second fastener being effective to maintain the third and fourth heel straps against the heel of the boot regardless of the size and configuration of the boot; the binding being formed of moisture impervious material which is flexible in one direction and substantially rigid in directions generally transverse to that one direction and which is dimensionally substantially stable regardless of exposure to moisture and frigid temperatures.

8 Claims, 8 Drawing Figures

SNOWSHOE AND HARNESS ASSEMBLY

FIELD OF THE INVENTION

This invention relates generally to the field of snowshoes and more particularly to the harness assembly employable in detachably connecting the snowshoe to a person's foot.

BACKGROUND OF THE INVENTION AND PRIOR ART STATEMENT

Heretofore, the prior art has proposed various configurations of snowshoe harness each, allegedly, providing benefits over what was known prior thereto. Generally, in the art of snowshoes, certain problems and/or considerations exist regardless of the configuration of the snowshoe, per se, and regardless of the particular use of such snowshoe. For example, the characteristics which would be desirable in a snowshoe harness would be having such snowshoe harness: (a) light in weight as to thereby minimize the energy expended by the person wearing the snowshoes; (b) easy to apply and detachably secure to the person's foot and shoe; (c) flexible as to readily conform to the configuration of the shoe on the foot of the person wearing the snowshoe; (d) infinite adjustability as between its minimum and maximum sizes thereby enabling the close attachment thereof to the person's shoe; (e) stability in dimensions thereby avoiding having the harness become loose, or tightened, while being worn by the person; (f) easily detached from the shoe of the person wearing the snowshoe; (g) resistant to damage from moisture and frigid temperatures; and (h) permitting normal foot movement of the person wearing the snowshoe while still assuring lateral stability of the snowshoe relative to the direction of intended travel of the snowshoe.

Even though some of the prior art snowshoe harnesses have provided some of such desirable characteristics, none have succeeded in providing all of such desirable characteristics.

For example, U.S. Pat. No. 1,747,213 dated Feb. 18, 1930, discloses a snowshoe harness comprised of a leather foot strap assembly having a transverse leather toe strap (10), provided with a plurality of spaced holes therethrough, which carries a toe cap member (16) and is provided with a buckle assembly (14) having a tongue for selective cooperate engagement with the holes in the leather toe strap. A rearwardly extending leather foot strap assembly (22) is of a generally U-shaped configuration with the ends thereof wrapped around rings or loops (17 and 18); such loops being made as from lamp wicking material. The loops (17 and 18) pass through the webbing of the snowshoe and are intended to form pivotal-like connections for the end loops (21 and 20) of the leather foot strap assembly (22) as well as pivotal connecting portions for the looped ends of leather toe strap (10). An additional leather instep strap assembly (24) is provided and as at its opposite ends as by the loop portions (27) connected to the rearwardly extending leather foot strap assembly (22) as to thereby keep the rearwardly extending leather foot strap assembly (22) at a selected height at the heel of the person's boot or shoe. In this arrangement the leather forming the various straps, when wet, stretches causing the entire harness assembly to become loose. This, in turn, requires the person to, in the field, attempt to tighten the harness. However, with a buckle arrangement employing a buckle tongue and cooperating spaced holes, correct adjustment is usually not attainable since the hole spacing dictates the increment of adjustment possible and more often than not, such increment of possible adjustment does not coincide with the actual adjustment needed. Further, the movement of the persons foot while using the snowshoe is a general rocking motion on the ball of the foot with the toes of the foot moving downwardly into the forward opening (33) of the snowshoe. Such necessary foot movement results in a relative motion as between any two or all of the elements comprised of the looped ends (12, 20 and 13, 21) of the leather straps (10 and 22), rings (17 and 18) and anchors (32—32) thereby resulting in dimensional changes and undesirable wear.

U.S. Pat. No. 2,420,261 dated May 6, 1947, discloses a snowshoe harness assembly (16) which has a relatively narrow transverse toe strap (27) looped at its ends as to be slidably received on extension portions (24) of a cover material (21) wherein the cover material (21) serves to cover a U-shaped stabilizer bar (18) which passes around the heel of the person's boot. Formed integrally with such cover material (21) is a leather ankle strap (47) having a plurality of spaced holes and a buckle with a buckle tongue for selective engagement with such holes, for adjustment purposes, for adjustably securing the U-shaped stabilizer bar and cover material to the person's foot. Additional transverse type strap means (45) is provided to bridge the space generally between the legs of the stabilizer bar (18) and to pass under the person's boot. The stabilizer bar (18) is connected to the snowshoe mainstay (12) as by tongue-type buckle assemblies. The structure disclosed by said U.S. Pat. No. 2,420,261 suffers from many of the same problems as does the structure of said U.S. Pat. No. 1,747,213 and, further, has the added weight of the stabilizer bar (18).

U.S. Pat. No. 2,619,742 dated Dec. 2, 1952, discloses a snowshoe harness comprised of a top portion (1) which is initially cut flat and which has oppositely disposed toe straps (2—2) secured at approximately 45° angles to the top portion (1). Each of the toe straps (2—2) has a cooperating tongue-type strap buckle assembly (4*a*). Also, the top portion (1) has a heel strap (3) which is fixedly secured at one end to the top portion (1) and adjustably secured as through tongue-type strap buckle means (4*b*) at its other end to the same top portion (1). The top straps (2—2) actually do not engage the toe portion of the person's boot but rather are, each, looped around the mainstay or braided cross thong (13) of the webbing as to serve as a pivotal-like connection to the snowshoe. The announced purpose of thusly placing the toe straps (2—2) at an angle and looping them around the mainstay (13) is that the top section (1) becomes formed into a generally tapered configuration (as indicated at 8 of FIG. 4) and such configuration, hopefully, serves to better grasp and locate the person's foot within the harness. As with the previously discussed prior art structures, the looped toe straps (2—2) rub against the mainstay and experience undesirable wear with such wear being further aggravated because of the necessary twisted configuration of such toe strap in order to pass under the cross mainstay of the snowshoe.

U.S. Pat. No. 2,821,031 dated Jan. 28, 1958, discloses a U-shaped heel piece (24) which has secured thereto a lateral strap (26) which, in turn, has its opposite ends somewhat spread outwardly and anchored to the frame (F) of the snowshoe at a point generally aligned with the person's instep. An instep strap (20) is passed through the ends of the U-shaped heel piece (24) as to pass both under the person's foot as well as over the instep portion where a cover or pad (22) is also provided. At the forward end a toe strap (10) is wrapped as to pass twice over the top of the person's toe as well as to be looped under the toe chord (14). A toe stop (18) is secured at its lower end as by lacing to the toe chord (14) and then wrapped as to be in front of the person's toe and pass over the toe to where it is secured at its upper end as to the toe cover member (16). The purpose of such a toe stop (18) according to the patentee is to present a positive forward abutment against which the person's foot can be placed. A modification discloses relatively shorter straps (42 and 44), instead of having a separate type of strap 26, being provided which are engaged with the ends of the U-shaped heel piece (24). The intended purpose of such strap 26 and/or straps 42–44 is to provide for lateral stability of the person's foot relative to the snowshoe assembly. As should be apparent, the problems of, for example, having to attempt to adjust many different tongue-type buckles and straps and the excessive wear of the toe strap (10) looping under the chord (14) exist in this structure as they do in the previously discussed prior art structures.

U.S. Pat. No. 2,987,834 dated June 13, 1961, discloses a snowshoe harness comprised of fixed pivot or anchor arms (22 and 24) generally staddling the toe opening in the snowshoe and a rigid U-shaped frame or member (20) which has its legs pivotally connected respectively to the fixed anchor arms (22 and 24). The U-shaped member (20), at the rear portion thereof, has an ankle strap (40) tied thereto which extends about the person's ankle as to thereby tend to draw the person's foot toward the bight portion of the U-shaped member (20). A second strap (44) also passing around the person's heel portion is secured to the legs of the U-shaped member (20) as to tend to draw the person's foot generally forwardly and in a direction away from the bight portion of the U-shaped member (20). As a consequence thereof the coacting straps (40 and 44) tend to secure the person's foot forwardly and rearwardly of the U-shaped member (20). Also, a toe strap (38) is provided which (apparently) is secured at its opposite ends to the legs of the U-shaped member (20) and which passes over the toe portion of the person's foot. Again, this structure, as other discussed prior art structures, has the drawbacks of belts or straps with spaced holes for limited adjustability and the very substantial extra weight of the fixed arms (22, 24) and the U-shaped member (20).

U.S. Pat. No. 3,000,117 dated Sept. 19, 1961, discloses another form of a rigid type of snowshoe harness wherein a rigid U-shaped heel-type abutment portion (10*b*) which is, in turn, connected as to extending arm or leg portions (10*a* and 10*c*) which arms or legs are, in turn, pivotally anchored to the frame of the snowshoe (as at pivots P—P). An ankle strap (16) is pivotally secured to the rigid U-shaped member in an area close to the heel as to pass around and in proximity to the person's ankle. Also, a toe strap (20) having its lower ends looped as about the toe chord (22) of the snowshoe passes over the toe portion of the person's foot. A rigid heel plate or bracklet (18) connected to the U-shaped member passes under as to engage the under-surface of the person's heel. As in, for example, U.S. Pat. No. 2,987,834, this structure also has the drawbacks of belts or straps with spaced holes for limited adjustability and the very substantial extra weight of the metal U-shaped member and pivot brackets (12 and 14 or 42—42).

U.S. Pat. No. 3,596,374 dated Aug. 3, 1971, discloses what amounts to a one-piece type snowshoe harness which is comprised of elastomeric material. The elastomeric harness or holder (12) when in its relaxed state has an aft end (21) with a heel engaging portion (22), a sole portion (23) and a toe portion (26) with an opening (32) formed therein. The material on either side of the opening (32), namely, areas 33 subsequently serve as strap portions when the person's foot is operatively engaged. As shown in FIGS. 1 and 2 thereof the device (12) is suitably secured as at four different points to the lacing of the snowshoe (13) as by suitable lacings leaving the forward most portion not directly connected to the snowshoe assembly. The person passes his foot through the stretched opening (32) and the entire area (defined by numbers 33—33 and 34) is stretched generally about the person's foot as to result in the area or portion 26 serving as a toe abutment area for the person's foot while the portion 33—33 and 34 extend generally rearwardly to circumscribe the person's foot. The structure shown by FIGS. 4 and 5 thereof is, in the main, the same as that shown in FIGS. 1, 2 and 3 with the exception that there is more of a pocket-like configuration to the structures (12) because of it being somewhat doubled-back and then anchored to the snowshoe assembly (13) as by lacing means (141). This particular structure has, with possible exception of excessive weight, all the undesired characteristics of any snowshoe harness. It lacks any significant lateral stability; the holding power (tightness of the harness onto the person's boot) is a factor of the size of that person's boot and the style of it; the elastomeric material, for the most part, at least significantly looses its elastomeric qualities in the frigid temperatures in which snowshoes are usually employed; and the rocking motion of the foot, at the ball thereof, atop the toe chord (18)tends to cause the foot to further stretch the forward portion (26) and thereby, instead of rocking on the toe chord (18) actually sliding forwardly and downwardly relative thereto.

U.S. Pat. No. 3,638,333 dated Feb. 1, 1972, discloses a molded snowshoe (10) comprised of rigid plastic material. A strap harness means 11 is disclosed as being comprised of strap portions (35, 36 and 37) which are all integrally formed or molded to a single piece and which is, in turn, operatively pivotally connected to the snowshoe by having the respective side strap portions (35 and 36) first looped under and about the foot pivot member (25) and then pass over the strap portion 37 and through slots (40 and 41) formed in such strap portion 37. The person then places the sole of his boot generally over the strap portion 37 with the ends of such strap portion 37 then being laced together as shown in FIG. 3 thereof to thereby hold the boot down against the strap portion 37 and indirectly against the transverse foot pivot 25. The side strap portions (35 and 36) are then extended generally along the sides of the boot and generally upwardly toward an elevated portion of the heel of the boot and such strap portions (35 and 36) are operatively connected to each other as by a heavy rubber band type loop connector 53 which is selectively engaged as with either notch portion 51 formed in strap portion 35. The elastomeric band (53), of course, looses a significant degree of its elastomeric qualities in frigid temperatures and, as is well known, the laces (50) become loosened after a period of use thereby requiring them to be re-tied in the field where such is not an easy or comfortable task.

U.S. Pat. No. 3,744,162 dated July 10, 1973, discloses a snowshoe harness which is very similar to a number of preceeding herein discussed prior art patents. For example, this patent discloses a toe piece (34) which is secured at its lower end as to the toe chord (17) and looped upwardly as to form an integral portion of a toe pad through which in turn passes a toe strap (21) which is double looped over the toe portion and also looped under the toe chord (17) to thereby provide for a pivot-like retainer for the toe. A heel strap (25) extends generally around the heel of the boot and is anchored at its opposite ends to the toe chord (17 as at 23 and 26). An additional strap (28) is provided which passes generally about the instep portion of the boot and in so doing passes through slots formed in the extending legs of the heel strap (25 as shown for example at 31 in FIG. 2). The patentee alleges that the instep strap (28), by passing through such slots (31) can maintain its relative position and hold the strap (25) close to the sides of the boot without any relative movement because of the strap (28) being, in effect, trapped against movement by such slots (31). Previous patents such as, for example, said U.S. Pat. No. 2,821,031, have shown much structure very similar to if not identical to much of the structure shown by this patent and the various drawbacks and undesirable characteristics of the structures of such previously discussed patents also exist in this snowshoe harness.

U.S. Pat. No. 3,755,926 dated Sept. 4, 1973, discloses structure very similar to said U.S. Pat. No. 3,744,162 as well as other prior art structures already considered herein. That is, this structure has a toe piece (14) similar to previous ones discussed and it has a toe strap arrangement which again is similar to ones previously discussed. It appears that the essential difference is that the side straps or side strap portions of the heel strap pass through slits formed in the toe strap (such slits being shown generally at 24 of FIGS. 1 and 2). Also somewhat similarly to said U.S. Pat. No. 3,744,162, an arch or instep type strap (34) is provided (similar to strap 28 of U.S. Pat. No. 3,744,162); however, it will be noted that instead of the slit being formed in the side portions of the heel strap (25) that in this patent the slits are formed at 36 in the instep strap 34 and not the sides of the heel strap (20). Apparently the entire assembly including the toe strap and abutment means (14) is pivotally secured to the snowshoe assembly by having the opposite ends of the heel strap (20) pass about and under the toe chord (30) of the snowshoe assembly. It appears, therefore, that there is no direct pivotal connection of the toe containment portion. That is, the sides or side portions of the heel strap extend through slots (24) formed on each side of the toe portion and immediately after passing through such slots the ends of the heel strap then extend at approximately 90° laterally away from the toe portion and are than anchored to the webbing preferably at some point close to the frame of the snowshoe. The inventor claims that this change in direction prevents the forward movement of the toe containment portion and that the heel strap therefore works not only to hold the foot into the toe portion but also serves as a pivot means and restrainer enabling the toe portion to pivot about toe chord (8) while also preventing forward movement of the toe portion by virtue of the laterally extending ends of the heel strap. Obviously, the geometry of the placement and direction of the various straps actually results in the person's foot not only moving forwardly of but also downwardly of the toe chord during use of the snowshoe. Also, such straps fail to present the desired degree of lateral stability and directional alignment of the person's foot relative to the desired direction of movement of the snowshoe. Further, the use of lacing (18) presents the same problems previously discussed as with regard to said U.S. Pat. No. 3,638,333.

U.S. Pat. No. 3,965,584 dated June 29, 1976, discloses a particular boot arrangement securable to a snowshoe. One of the embodiments illustrates a boot or a moccasin (1) provided with boot side wall portions (3—3), a top portion (2) with side strap portions (4—4) respectively secured to the side walls (3—3) as in the area of the ball of the foot. The side straps (4—4) are attached thereto as to form an intermediate loop or passage portion. A generally transversely extending strap (6) provided with buckles (8) at each end thereof is suitably secured as by a rivet (7) to the top; however, there is no description as to what such a guide loop is employed for. A pair of straps (10) are provided and each of such straps (10) has an elongated slot (11) formed therein and a plurality of holes (12) with such holes and slots being formed at respective opposite ends of each strap. Each of such straps is looped about the toe chord portion (13) of the snowshoe so as to have each strap pass through its longitudinal slot (11) and then extend through the loop or passage portion of the adjacent side strap (4) of the boot (1) and then ultimately have the end which is provided with the holes (12) engage with the adjacent buckle (8) of the transverse strap (6) thereby providing a pivotal connection between the boot (1) and the toe chord (13) by virtue of such straps (10) and also hopefully prevent forward or rearward movement of the boot (1) by virtue of such straps (10) passing through the side strap loops (4) secured to the boot (1). FIGS. 5 and 6 thereof illustrate a modification wherein the modified portion resides in not providing a transverse strap (6) but rather providing the straps (14 and 15) which functionally replace the straps 10 and wherein a buckle assembly (13) is carried by one end of the one strap (14) so as to engage with the opposite free end of the other strap (15). Again not only is there limited adjustment because of the straps employing holes and tongue-type buckles, but also the snowshoe is limited to use by a person or persons having exactly the foot size matching the size of the mocassin (1). Because of the configuration of the tying straps and the relatively supple nature of the material forming the mocassin (1) lateral stability and alignment of the person's foot is effectively precluded.

U.S. Pat. No. 3,992,790 dated Nov. 23, 1976, discloses a snowshoe harness which is comprised of a flat elongated rectangular member (14) made-up of belting material or the like which extends under the ball of the person's boot. Attached to the lateral ends of such member (14) are the ends of a heel strap (36) and toe strap portions (30 and 44) all of which are respectively fixedly secured as by spring steel bars (40) overlapping all of such with rivets (42) passing therethrough. The forward ends of such assembled portions are, in turn, provided with flexible loops (18) which are made of spring steel or the like and such loops (18), in turn, pass about the toe chord of the snowshoe so as to enable the entire assembly to pivot thereabout. The heel strap has the conventional adjustable tongue-type buckle means. This structure, of course, causes excessive wear at the pivot loops (18) and has the problems associated with lacing (34) as previously described. The tongue-type buckle coacting with the holes in the heel strap (36), of course, provides for only limited adjustability thereof. Further, the framing and fastener members (as at 42—42, 40—40, 46 etc) add to the weight which the person must lift with every step.

U.S. Pat. No. 4,085,529 dated Apr. 15, 1978, discloses not only a particular harness arrangement but also a new form of snowshoe itself. In the snowshoe arrangement a cross member (26) is provided as to be secured to the frame sides by respective cross member clamps (28 and 30) which are selectively adjustable relative to the frame so that the cross member can be positioned in a position most closely conforming to the normal position of a person's foot. In any event, the harness structure (36) is comprised of a tongue or toe piece (60) having its lower end secured to the cross-member (26) as by being sandwiched and secured thereto by a plate (66) and suitable screws. The upper end of the toe piece (60) is provided with a loop and buckle arrangement (68) which, in turn, accepts a toe strap (62) which is also provided with suitable buckle means for adjustment purposes. An adjustable heel strap extends around the heel of the boot and has its opposite ends connected to respective rings (70) as are the respective opposite ends of the toe strap (62). Such rings (70) are, in turn, connected through respective links (78) to respective eye bolts (72). Such bolts (72) are, in turn, anchored to the cross-member (26) as to be in a position generally straddling the width of the person's foot. The arrangement enables the person while walking to pivot his foot about the pivot bar (66) and in so doing in effect cause the straps (62 and 64) to become somewhat loosened as generally depicted in FIG. 8 thereof thereby enabling the person to laterally move his heel portion and still bring that heel portion down to the proper position when the person again steps fully down onto the snowshoe. In this arrangement, as the person walks forwardly the person's foot will actually slide forwardly and downwardly relative to transverse cross member because of the lost motion in linkages 78 (during rocking motion of the foot) and the resulting effective loosening of the toe strap 62.

Accordingly, the invention as herein disclosed is primarily directed to the solution of the foregoing problems of the prior art.

SUMMARY OF THE INVENTION

According to the invention, a harness for a snowshoe having toe chord means, comprises an elongated binding extending generally transversely of said snowshoe and being secured generally medially of opposite first and second ends to said toe chord means as to have said first and second ends movable with respect to said snowshoe, first and second toe strap means respectively secured to said first and second ends of said binding, a first strap fastener carried by said first strap means, third and fourth heel strap means respectively secured to said first and second ends of said binding, a second strap fastener carried by said third heel strap means, said first and second toe strap means being operative for drawing said first and second ends of said binding against opposite sides of a boot worn by a person walking on said snowshoe and said first fastener being effective to maintain said first and second ends tightly against said boot regardless of the size or configuration of said boot, said third and fourth heel strap means being operative for drawing and holding the toe portion of said boot within said tightly engaging first and second ends and said second fastener being effective to maintain said third and fourth heel strap means against the heel of said boot regardless of the size and configuration of said boot, said binding being formed of moisture impervious material which is flexible in one direction and substantially rigid in directions generally transverse to said one direction and which is dimensionally substantially stable regardless of exposure to moisture and frigid temperatures.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
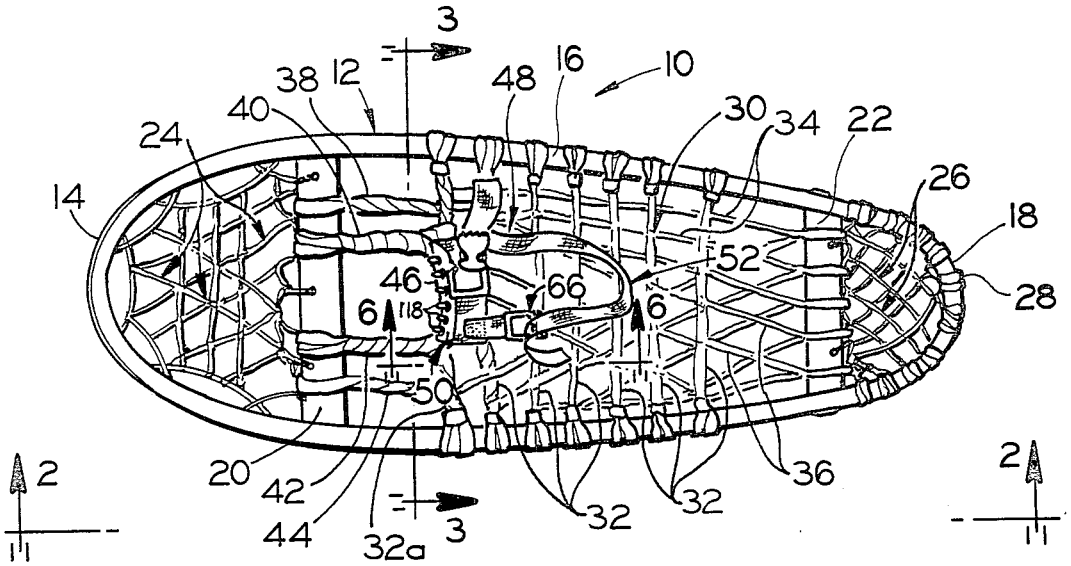
FIG. 1 is a top plan view of one form of snowshoe provided with harness means employing teachings of the invention.
Figure 2:
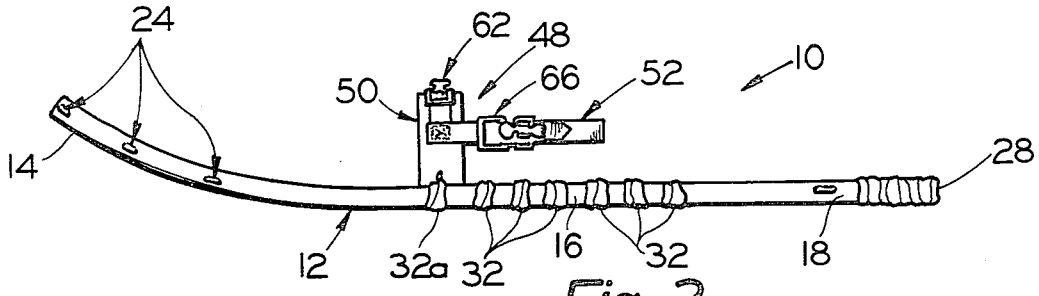
FIG. 2 is a view taken generally on the plane of line 2—2 of FIG. 1 and looking in the direction of the arrows.
Figure 3:
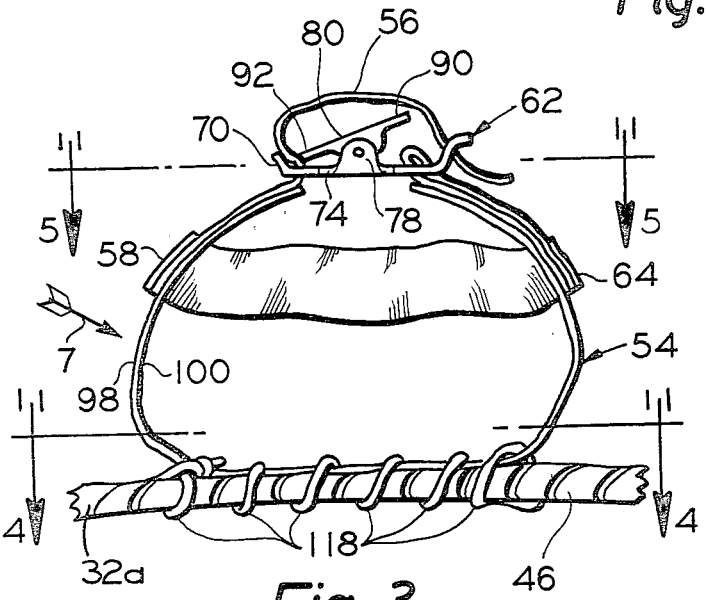
FIG. 3 is an enlarged fragmentary cross-sectional view taken generally on the plane of line 3—3 of FIG. 1 and looking in the directions of the arrows.

Referring now in greater detail to the drawings, FIGS. 1 and 2 illustrate a snowshoe 10 as being comprised as of a wood frame 12 having forward, medial and aft or rear portions 14, 16 and 18, respectively, with the aft and medial portions 18 and 16 being generally flat (as viewed in FIG. 2) while the forward portion curves generally upwardly. A first cross member 20 may be considered as generally separating the forward 14 from the medial portions 16 while a second cross member 22, spaced from the member 20, may be considered as generally separating the medial 16 from the aft 18 portions.

A forward webbing portion 24 is strung as through apertures within the forward portion 14 of frame 12 and secured as to the forward cross member 20. A rearward or aft webbing portion 26 may be secured to the rearward frame portion 18 as by being wound thereabout, as generally depicted at 28, and secured to rearward cross member 22. The snowshoe 10 is also provided as with a medially disposed webbing portion 30 which may be comprised of a plurality of generally transverse stringers or sections 32, tied as about opposite sides of the frame 12; a second plurality of stringers or sections 34 interwoven with stringers 32 tied as at respective first ends as to one side of the frame 12 and tied as at respective second ends as to the rearward cross member 22, and a third plurality of stringers or sections 36 interwoven with stringers 32 and 34 tied as at respective first ends as to the other side of the frame 12 and tied as at respective second ends as to the rearward cross member 22.

The forward most transverse stringer 32*a* is preferably made as of a plurality of twisted strands as to be substantially thicker than the other stringers 32 and to thereby serve as toe chord means. More particularly, such thickened stringer 32*a* may also serve as an anchor for some of the stringers 34 and 36 and, in turn, is preferably anchored as by relatively thick strands, members or portions 38, 40, 42 and 44 connected to the forward cross member 20. Functionally, it may be considered that the toe chord means 46 exists generally between longitudinal supports 40 and 42 and that the space or area defined generally by the boundary collectively defined by and between support 40, forward cross member 20, support 42 and toe chord means 46 is space for the toe portion of the person's boot to enter while that boot is generally rocking on the toe chord means 46 and the person is walking forward. The webbing and supports may be comprised of any suitable material; however, in the preferred embodiment rawhide is employed in the forming thereof and subsequently covered with a water-proofing coating such as, for example, a varnish.

As depicted in FIGS. 1 and 2, the snowshoe 10 is provided with a foot or boot harness 48, secured as to the toe chord means 46, and comprised as of a toe strap means 50 and heel strap means 52.

Figure 6:
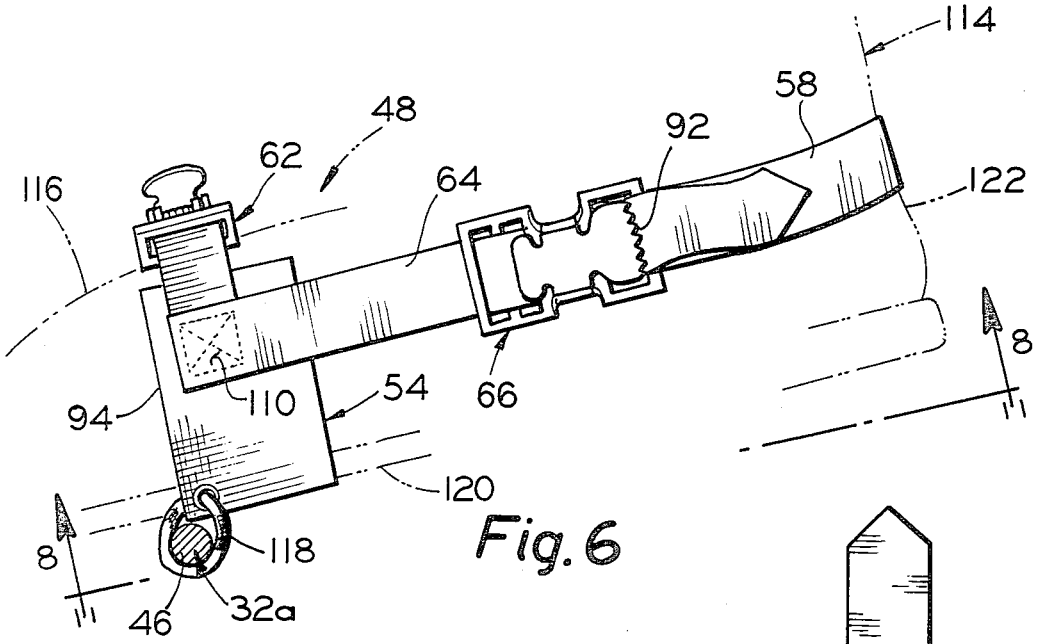
FIG. 6 is an enlarged view taken generally on the plane of line 6—6 of FIG. 1 and looking in the direction of the arrows but illustrating the harness in a position as would occur when the person was stepping forward with the other leg thereby lifting the heel of the boot generally about the snowshoe toe chord means or mainstay.
Figure 7:
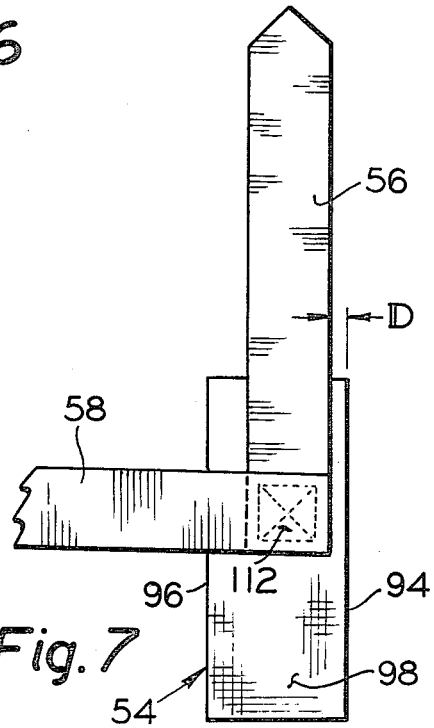
FIG. 7 is a fragmentary generally side view, taken generally in the direction of arrow 7 of FIG. 3 except that one of the straps is shown unlatched and extending in a plane generally perpendicular to the direction of said arrow 7.
Figure 8:
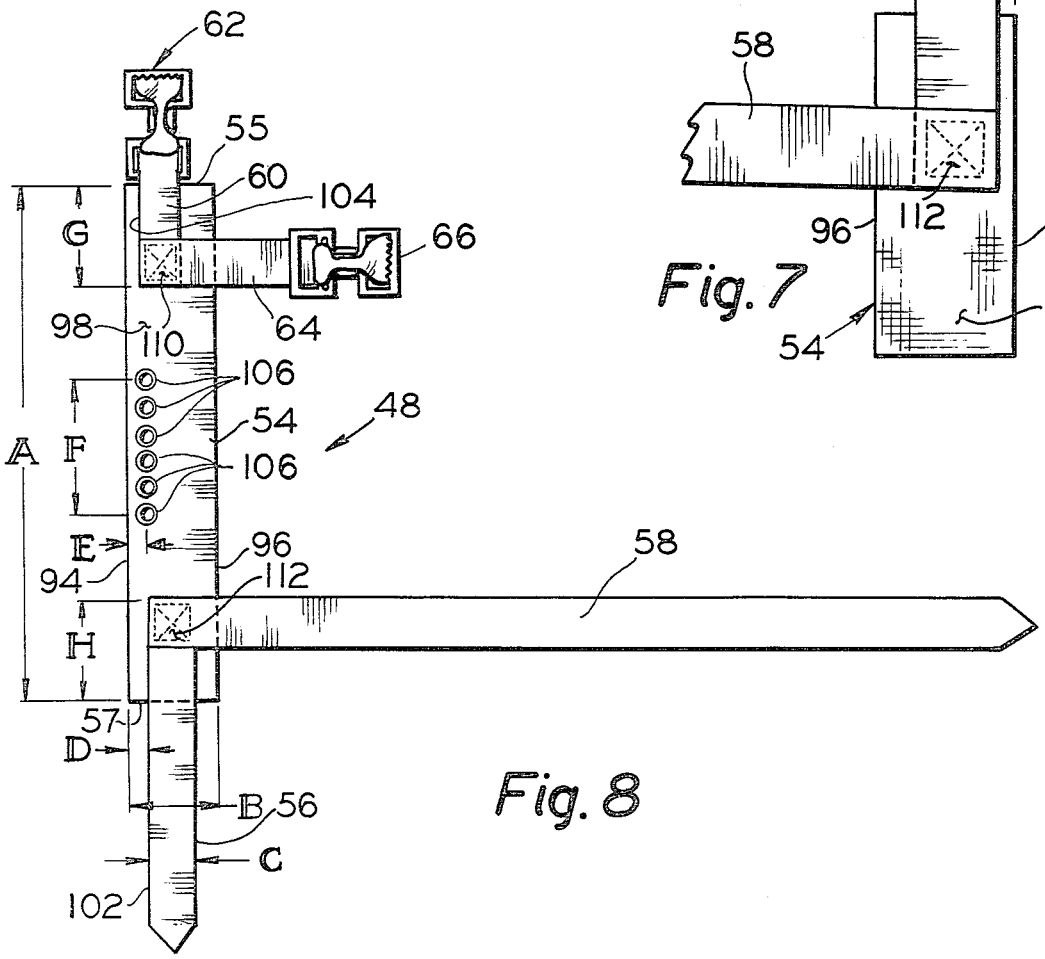
FIG. 8 is a view as if taken generally on the plane of line 8—8 of FIG. 6 and as if the harness of FIG. 6 was opened in all directions and layed flat.

Referring to all of the Figures and in particular to FIGS. 3–8 which are relatively enlarged views, with FIG. 8 being somewhat enlarged compared to FIGS. 1 and 2 but not quite as enlarged as FIGS. 3–7, the toe strap means 50 is illustrated as, preferably, comprising a first elongated binding portion or section 54 which has at or near one end thereof a first relatively narrower toe strap or belt portion or section 56 and a first relatively narrower heel strap or belt portion or section 58. At or near the opposite end of binding portion or section are secured a second relatively narrower toe strap or belt portion or section 60 having, in turn, a fastener or buckle-like clasp 62 secured thereto, and a second relatively narrower heel strap or belt portion or section 64 having, in turn, a fastener or buckle-like clasp 66 secured thereto.

Figure 5:
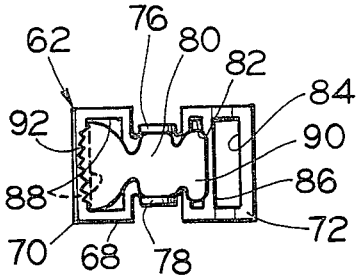
FIG. 5 is a view of one of the elements shown in FIG. 3 taken generally on the plane of line 5—5 of FIG. 3 and looking in the direction of the arrows.
Figure 4:
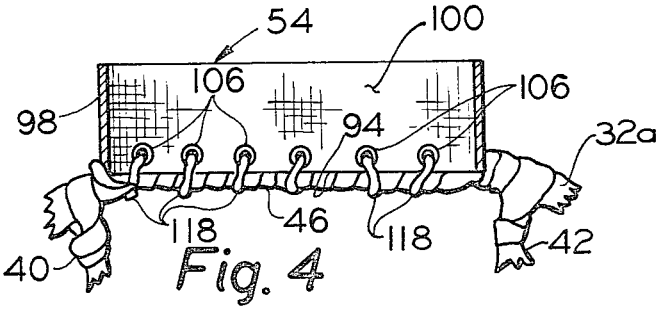
FIG. 4 is a cross-sectional view taken generally on the plane of line 4—4 of FIG. 3 and looking in the direction of the arrows.

As depicted in, for example, FIGS. 5 and 6, each of the clasp assemblies 62 and 66 may be comprised of a main body 68 having end body portions 70 and 72 and an intermediate body portion 74 which intermediate body portion comprises a pair of oppositely disposed pivot supports 76 and 78 which, in turn, pivotally support a clasping and release lever 80. Body portion 72 is provided with a pair of slot-like openings 82 and 84 permitting the end of a strap (such as either 60 or 64) to pass therethrough and be looped about the wall 86 (between openings 82 and 84) as to thereby secure the clasp assembly 66 or 62 to such strap. Body portion 70 is provided with an opening 88 formed therethrough for the passage of the end of the coacting strap or belt portion such as either the free end of strap 56 or strap 58. The lever 80 may be considered as having an actuator end 90 and a grasping end 92. A suitable torsion spring, or the like, not shown but well known in the art, is preferably situated as between the intermediate body portion 74 and lever 80 as to continually resiliently urge the lever 80 into the position generally depicted in FIG. 3 whereby the somewhat serrated grasping end 92 engages the strap 56 (or in the case of clasp assembly 66, the strap 58) and urges it against the side of opening 88 and thereby hold such strap from being withdrawn from the opening 88. When it is desired to release, for example, the toe strapping means, all that is necessary is to push the actuator end 90 of lever 80 downwardly (as viewed in FIG. 3) thereby releasing the belt or strap portion from between the clasping end 92 and buckle body portion 70 and permitting withdrawal of the strap means from opening 88.

For ease of reference, let edge 94 of the binding means 54 be considered the forward edge thereof and let edge 96 be considered the aft or rear edge thereof. Further, let surfaces 98 and 100 be considered the outer and inner surfaces, respectively, thereof.

Similarly, let edges 102 and 104 of toe strap portions or sections 56 and 60 be considered as the forward edges thereof.

As a result of experimentation and testing, it has been discovered that certain dimensional relationships are preferred in practicing the invention. For example, it is preferred that the overall length, when layed-out flat, of the binding means or portion 54 be in the order of 11.5 inches (as depicted by dimension A); that the width of the binding means or portion 54 be in the order of 1 15/16 inches (as depicted by dimension B) and that the cross-sectional thickness of the binding portion 54 be at least 1/16 inch. Further, it has been discovered that nylon material tightly woven into belt-like stock and rated at a strength of 1000 lbs. test, can be obtained having all of such preferred dimensions. Such belt-like nylon provides other highly desirable characteristics which are employable in the invention. That is, the belt-like material, although effectively non-stretchable, is flexible when, for example, wound upon itself in the longitudinal direction; however, it is substantially rigid and inflexible when attempts are made to bend it in directions (other than being rolled or wound upon itself) as, for example, from either the forward edge 94 (non-rollingly) rearwardly or from the aft or rearward edge 96 (non-rollingly) forwardly. Further, by employing nylon material, or the like, the wear qualities and dimensional stability are at a maximum and are not in any way damaged or impaired by moisture or frigid temperatures.

Generally medially between the opposite ends of binding 54 a plurality of eyelets (preferably of metal) 106 are inserted through the material as to have their respective centers spaced generally equidistantly from each other and spaced in the order of 3 3/16 inch from the forward edge 94 as generally depicted by dimension E. In the preferred arrangement the overall center distance between opposite end eyelets 106 is in the order of 3 3/16 inches as generally depicted by dimension F.

It has also been discovered that the actual means for securing the binding portion to the person's boot is best accomplished by toe strap portions which are narrower than the binding 54 and in this regard it has been determined that in the preferred embodiment of the invention that toe straps 56 and 60 each be of a width in the order of 1.0 inch, as depicted by dimension C and that the thickness thereof be in the order of 1/16 inch or less. As with the binding 54, it has been discovered that nylon material tightly woven into belt-like or strap-like stock can be obtained having all of such preferred dimensions. Such strap-like stock being of nylon material provides the same highly desirable characteristics as does the material for the binding 54 and, further, since it is narrower and of preferably reduced thickness the flexibility thereof is substantially greater than that of the binding 54 while still being effectively non-stretchable and possessing dimensional stability during use. In the preferred embodiment heel strap portions 58 and 64 are formed of the same material as are toe strap portions 56 and 60.

As possibly best illustrated in FIG. 8, toe straps 60 and 56 are secured to the binding portion 54 as to have the forward edges 104 and 102, thereof, each set back from the forward edge 94 of binding 54 by a distance in the order of $\frac{3}{8}$ inch. This, of course, results in the respective aft edges of such straps 60 and 56 being a distance in the order of 9/16 inwardly of the aft edge 96 of binding 54. Although not essential to the practice of the invention, it is preferable that such toe straps 60 and 56, although in medial alignment with each other, are, nevertheless at least slightly out of medial alignment with the medial longitudinal axis of binding 54. The placement of such toe straps as described, achieves that preferred configuration.

As generally depicted in each of FIGS. 6, 7 and 8, and possibly best in FIG. 8, in the preferred embodiment both straps 60 and 64 are secured to the binding 54 at an area spaced from the end 55 of binding 54 and, similarly, straps 56 and 58 and also secured to the binding 54 at an area spaced from the end 57 of binding 54. More specifically, in the preferred arrangement, the end of strap 64 is layed over the end of strap 60 and the area 110 defined by such common crossed portions of the straps 60 and 64 is then the area which is sewn to the binding 54. Preferably, the thread employed for such sewing is also nylon. When thusly stitched and sewn, the area 110, at its inner-most end is situated in the order of $2\frac{1}{4}$ inches away from edge 55 as generally depicted by dimension G.

Similarly, in the preferred arrangement, the end of strap 58 is layed over the end of strap 56 and the area 112 defined by such common crossed portions of the straps 58 and 56 is then the area which is sewn to the binding 54. Preferably, the thread employed for such sewing is of nylon. When thusly stitched and sewn, the area 112, at its inner-most end is situated in the order of $2\frac{1}{4}$ inches away from edge 57 as generally depicted by dimension H.

By so attaching the toe straps and heel straps certain benefits are obtained. That is, certain free lengths of the binding 54 are left as to thereby permit such to more freely conform to the configuration of the boot 114 (FIG. 6) while still permitting the toe straps 56 and 60 to bear down, over and against such free lengths thereby trapping such free lengths between the toe straps 56 and 60 and the toe portion 116 of the boot 114.

As previously stated, eyelets 106 are preferably provided and the size of the holes thereof is preferably in the order of $\frac{1}{4}$ inch diameter. Further, preferably, the binding 54 is secured to the toe chord or mainstay means **32*a* as by, for example, nylon cord 118 of 3/16 inch diameter (although it is possible to use a leather thong or strip) which is wound under the toe chord 32*a*, through the respective eyelets 106 and over the top of that narrow portion of the binding 54 between the eyelets and forward edge 94 of the binding 54. The securing strip 118 is tightened and suitably secured thereby holding the binding 54 to the toe chord 32*a***.

As should now be apparent, the preferred form of the entire harness assembly of the invention is of very light weight thereby reducing the energy which the person has to expend during use of the snowshoes. By having the binding 54 and straps of woven nylon, such retain dimensional stability regardless of the ambient temperatures and any moisture which may come into contact therewith. By employing clasp type fasteners (instead of tongue-type buckles which cooperate with spaced holes in a coacting belt portion) infinite incremental adjustment of all toe and heel belts is easily accomplished. Because of the rigidity (non-flexibility) of the woven binding in directions forward or aft thereof, the binding when held against the outer surface of the boot 114 by the tightened toe straps 60 and 56 the thusly held binding provides a rigid structure which is effectively non-flexible in the longitudinal direction of the snowshoe. By having the toe straps and heel straps anchored (sewn) to the binding 54 at common locations stresses applied by such belts are applied to single common locations of the binding 54 and therefore are at least partially transferred from one belt and into another rather than causing possible deformation of the binding 54. That is, if, for example, in FIG. 6 the ends of the heel belts or straps were anchored to the binding 54 at locations substantially above or below where the toe straps are sewn, any excessive force applied by the heel straps would cause a force couple or moment generally about the areas where the toe straps were thusly sewn and possibly result in partial deformation of the binding. Also, because of the securing of the binding 54 to the top of the toe chord **32*a* and then having the person place the sole 120 of the boot downwardly thereon, the woven generally non-deflectable (in that direction) material of the binding is forced to experience some degree of flexing as against the top of the toe chord 32*a* during walking and such serves only to momentarily tighten the binding 54 against the surface of the boot 114 and the toe chord 32*a* as to result in providing for enhanced forward and lateral stability of the boot relative to the snowshoe. Further, by securing the heel straps to the binding 54 in the manner disclosed the heel straps actually become inclined in two directions because of the generally inclined attitude assumed by those related portions of the binding against the boot. This results in the lower disposed edges of the coacting heel straps being effectively longer than the upper disposed edges of such coacting heel straps resulting in a somewhat flared condition which then effectively best conforms to the heel portion 122** of the boot preventing downward slippage of the heel strap means once tightened.

Although only a preferred embodiment of the invention has been disclosed and described, it is apparent that other embodiments and modifications of the invention are possible within the scope of the appended claims.

What is claimed is:

1. A harness for a snowshoe having toe chord means, comprising an elongated binding extending generally transversely of said snowshoe and being secured generally medially of opposite first and second ends to said toe chord means as to have said first and second ends movable with respect to said snowshoe, first and second toe strap means respectively secured to said first and second ends of said binding, a first strap fastener carried by said first strap means, third and fourth heel strap means respectively secured to said first and second ends of said binding, a second strap fastener carried by said third heel strap means, said first and second toe strap means being operative for drawing said first and second ends of said binding against opposite sides of a boot worn by a person walking on said snowshoe and said first fastener being effective to maintain said first and second ends tightly against said boot regardless of the size or configuration of said boot, said third and fourth heel strap means being operative for drawing and holding the toe portion of said boot within said tightly engaging first and second ends and said second fastener being effective to maintain said third and fourth heel strap means against the heel of said boot regardless of the size and configuration of said boot, said binding being formed of moisture impervious material which is flexible in one direction and substantially rigid in directions generally transverse to said one direction and which is substantially stable regardless of exposure to moisture and frigid temperatures.

2. A harness according to claim 1 wherein said binding comprises a woven belting-like material formed of water impervious material and having a width in the order of 1-15/16 inches and a thickness in the order of 1/16 inch.

3. A harness according to claim 2 wherein nylon comprises said material.

4. A harness according to claim 2 wherein said binding has a longitudinal length in the order of $11\frac{1}{2}$ inches and wherein nylon comprises said material.

5. A harness according to claim 2 wherein said binding has a longitudinal length in the order of $11\frac{1}{2}$ inches, wherein nylon comprises said material, wherein said toe strap means comprises woven belting-like material which is impervious to water and which has a width in the order of 1.0 inch and a thickness in the order of 1/16 inch.

6. A harness according to claim 5 wherein nylon comprises the material forming said toe strap means.

7. A harness according to claim 6 wherein said heel strap means is formed of nylon belting-like material and has a width in the order of 1.0 inch and a thickness in the order of 1/16 inch.

8. A harness according to claim 7 wherein said heel strap means and said toe strap means are secured to said binding at areas which are common to said heel strap means and said toe strap means.

* * * * *